US005647275A

United States Patent [19]

Lupa et al.

[11] Patent Number: 5,647,275

[45] Date of Patent: Jul. 15, 1997

[54] REMOVABLE CYLINDER COUPLING

[75] Inventors: Jürgen Lupa, Ludwigshafen; Rolf Müller, Grossniedesheim, both of Germany

[73] Assignee: Koenig & Bauer-Albert Aktiengesellschaft, Wurzburg, Germany

[21] Appl. No.: 563,790

[22] Filed: Nov. 28, 1995

[30] Foreign Application Priority Data

Nov. 30, 1994 [DE] Germany ..... 44 42 575.9

[51] Int. Cl.[6] ..... B41F 13/26; B41F 13/44

[52] U.S. Cl. ..... 101/216; 101/348

[58] Field of Search ..... 101/216, 212, 101/219, 181–184, 178, 247, 248, 228, 348, 349, 351, 352, 141, 142, 136, 137; 384/256, 257, 273, 416; 29/898.07, 898.08; 492/16, 17, 18, 45

[56] References Cited

U.S. PATENT DOCUMENTS 3,611,926 10/1971 Johnson .

4,878,427 11/1989 Washchynsky .

FOREIGN PATENT DOCUMENTS 674128 4/1939 Germany .
1858031 6/1962 Germany .
1983546 4/1968 Germany .
3837625 11/1989 Germany .
4314082 4/1995 Germany .

*Primary Examiner*—J. Reed Fisher
*Attorney, Agent, or Firm*—Jones, Tullar & Cooper, P.C.

[57] ABSTRACT

A coupling for a removable cylinder in a rotary printing machine facilitates the removal of the cylinder without disrupting the gear drive wheel for the cylinder. An axially shiftable control shaft is coupled to the cylinder through a switchable coupling. The control shaft drives the cylinder from a hollow shaft through an interlocking coupling. The gear drive wheel is carried by the hollow shaft.

5 Claims, 1 Drawing Sheet

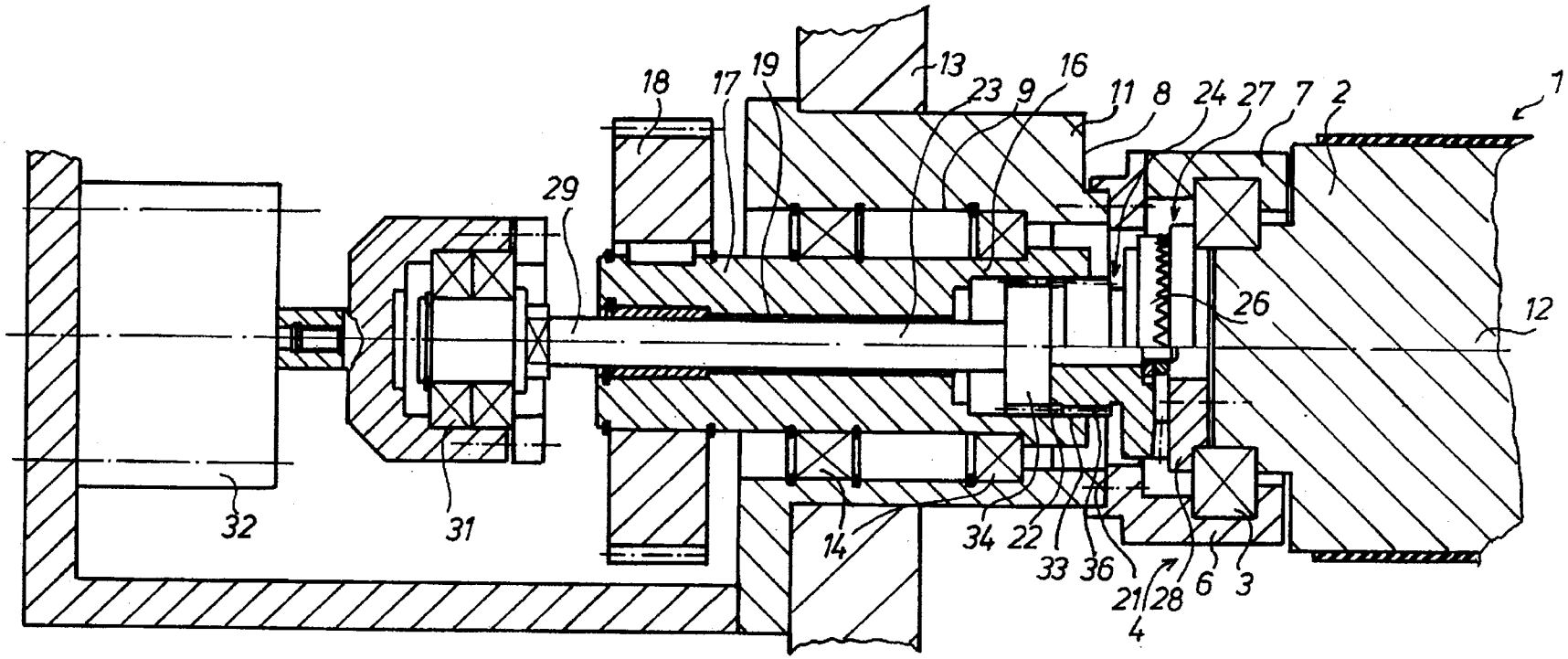
1
12
2
7
27
24
8
11
16
9
23
13
19
17
18
29
31
32
26
3
6
28
21
4
36
33
22
34
14

REMOVABLE CYLINDER COUPLING

FIELD OF THE INVENTION

The present invention is directed generally to a removable cylinder coupling. More particularly, the present invention is directed to a coupling for connecting a removable cylinder to a drive wheel. Most specifically, the present invention is directed to a releasable coupling for connecting a removable cylinder of a rotary printing press to a drive wheel. The cylinder has a bearing secured to a cylinder end journal and this bearing is supported by a separable bearing receptacle which is attached to a bearing bushing. The bearing bushing, in turn, supports a hollow shaft which carries the drive wheel. A control shaft is shiftable axially within the hollow shaft and is usable to engage and disengage a coupling between the hollow shaft and the cylinder. The cylinder can thus be removed from the printing press without disrupting the drive gear wheel.

DESCRIPTION OF THE PRIOR ART

In the field of rotary printing presses, it is typically very important to be able to accurately position one cylinder with respect to other cylinders in the press assembly. Gear drive assemblies are frequently used to drive the various cylinders in a precise, interrelated manner. As will be readily appreciated, if the various drive gears become worn or do not properly engage each other, the relative rotational position of one cylinder with respect to is cooperating cylinders can be altered. Such a shift in cylinder position can result in register errors and other printing problems.

In performing various printing processes, it is often necessary to remove one cylinder from the press assembly and to replace it with another cylinder that may have a different size or peripheral surface. The removal of a cylinder also often includes removal of the drive gear wheel which is coupled or connected to the cylinder. Such unmeshing of the cylinder's drive gear wheel and the enmeshing of the new drive gear wheel is apt to cause unwanted wear on the gear train with a resultant possible misadjustment of cooperating cylinders.

In German Utility Model DE-GM 1 983 546 there is disclosed a removable printing cylinder whose cylinder journals are provided with bearings. These bearings are received by rotatable bearing bushings having an eccentric cutout and which are disposed in a frame. A gear drive wheel is fastened by use of a coupling to one of these bearing journals in a torsion-proof manner.

It will be apparent that a need exists for a device for connecting a removable cylinder to a gear drive wheel which overcomes the limitations of the prior art devices. The removable cylinder coupling in accordance with the present invention provides such a device and is a significant improvement over the prior art.

SUMMARY OF THE INVENTION

It is an object of the present invention to provide a removable cylinder coupling.

Another object of the present invention is to provide a drive for connecting a removable cylinder to a drive wheel.

A further object of the present invention is to provide a releasable coupling for connecting a removable cylinder of a rotary printing press to a drive gear wheel.

Still another object of the present invention is to provide a removable cylinder coupling in which the drive gear wheel is fixed in place.

Yet a further object of the present invention is to provide a device for connecting a removable cylinder having journals provided with bearings to a drive wheel.

As will be set forth in detail in the description of the preferred embodiment which is presented subsequently, the removable cylinder coupling in accordance with the present invention is used to correct a removable cylinder of a rotary printing press to a drive wheel, such as a gear wheel. The cylinder has cylinder journals that carry bearings with these bearings being received in bearing receptacles. These bearing receptacles are situated at one end of a bearing bushing that is supported by a side frame of the printing press. The bearing bushing has a central bore which receives a hollow shaft that not is shiftable axially in the central bore but that is rotatable in the bore. The hollow shaft supports a control shaft which is axially shiftable. This control shaft carries a switchable coupling that has a coupling half attached to the cylinder journal and a coupling half secured to the control shaft. The control shaft is also attached to the hollow shaft by an interlocking coupling so that it will rotate with the hollow shaft. A drive wheel, in the form of a gear drive, is attached to the outer surface of the hollow shaft. If the cylinder is to be removed, the control shaft is shifted axially in the hollow shaft to separate the switchable coupling halves. The bearing receptacle can then be separated into its two components which allows the removable cylinder to be taken out of the press frame while keeping the drive gear wheel secured in place.

The removable cylinder coupling in accordance with the present invention insures that the highly precise gear wheels, which are used as drive wheels for the rotary printing press, will retain their precise running properties. Since the drive wheels remain in place and are not shifted or removed with the removable cylinder, they will not deteriorate. Therefor, a drive wheel fixed in place on the printing press frame will remain fixed in place and will thus be assured of retaining its good running properties. In addition, since the drive wheel of a particular cylinder is often an intermediate wheel of a gear, the gear remains fully functional even if the cylinder, to which it had previously been connected by the removable cylinder coupling of the present invention, has been removed.

The removable cylinder coupling of the present invention overcomes the limitations of the prior art. It is a substantial advance in the art.

BRIEF DESCRIPTION OF THE DRAWINGS

While the novel features of the removable cylinder coupling in accordance with the present invention are set forth with specificity in the appended claims, a full and complete understanding of the invention may be had by referring to the detailed description of the preferred embodiment which is presented subsequently, and as illustrated in the accompanying sole drawing FIGURE which is a side elevation view, partly in section, of a removable cylinder coupling in accordance with the present invention.

DETAILED DESCRIPTION OF THE PREFERRED EMBODIMENT

Referring now to the sole drawing FIGURE, there may be seen a preferred embodiment of a coupling for a removable cylinder of a rotary printing press in accordance with the present invention. A cylinder 1 of a rotary printing press is provided with a cylinder journal 2 at its end. It will be understood that only one end journal 2 of the cylinder 1 is depicted in the drawing FIGURE and that the second end of the cylinder 1 may have the same construction. It will also be understood that cylinder 1 is intended to be exemplary of a number of cylinders in a rotary printing press with the rest of the printing press not being shown in the drawing for ease of illustration.

The cylinder journal 2 is provided with a bearing 3. This bearing 3 is disposed in a bearing receptacle 4 comprised of two bearing receptacle half shells 6 and 7, which can be separated from each other. Bearing receptacle 4 is fastened on an end face 8 of a bearing bushing 11 which is provided with a central, axially extending bore 9. The cylinder 1 is concentrically rotatable in relation to its axis of rotation 12. The bearing bushing 11 is disposed axially immovably in a frame 13 and can be designed to be eccentric as well as to be pivotable. By means of this, it is possible to change the distance of cylinder 1 from an adjoining cylinder, not shown. The central bore 9 of the bearing bushing 11 has a bearing set 14, which is concentric in respect to the axis of rotation 12, and which provides for the rotatable, axially fixed reception of a hollow shaft 16. On its end 17 remote from the cylinder 1, this hollow shaft 16 is connected with a drive wheel 18. A central, axially extending bore 19 of the hollow shaft 16 is provided, on an end 21 close to the cylinder, with an interlocking coupling 22 which compensates for an offset in the axial direction. Thus, the interlocking coupling 22 is shiftable axially in the bore 19 of the hollow shaft 16. This coupling 22 connects the hollow shaft 16 and a control shaft 23 with each other in a torsion-proof manner. Control shaft 23 is axially displaceable inside the hollow shaft 16 and is concentrically seated in hollow shaft 16 in respect to the axis of rotation 12 of cylinder 1. A first end 24 of the control shaft 23, which is situated near the cylinder 1, is provided with a first coupling half 26 of an interlocking, switchable coupling 27. This switchable coupling 27 connects the control shaft 23, in a manner fixed against relative rotation, with the cylinder 1, on whose cylinder journal 2 a second coupling half 28 of the switchable coupling 27 is fastened. A second end 29 of the control shaft 23, that is remote from the cylinder, is connected by means of a bearing 31 in a tension-and pressure-proof manner with an adjusting device 32 which is fixed in an axial direction on the frame. Adjusting device 32 may be, for example, a pneumatic cylinder 32, which performs an adjustment movement of the control shaft 23 in the axial direction.

In the preferred embodiment, the interlocking coupling 22 connecting the hollow shaft 16 and the control shaft 23 is embodied as a toothed coupling that is free of radial or circumferential play. The bore 19 of the hollow shaft 16 is provided with interior teeth 33, while the coupling 22 is comprised of two sets of exterior teeth 3 and 36. The first set of exterior teeth 34 is disposed on a disk that is secured to the control shaft 23 so as to be rotatable and grippable or securable in the circumferential direction with respect to the second set of teeth 36. For removing the toothed play between the first and second sets of exterior teeth 34 and 36, and the interior teeth 33, the first set of exterior teeth 34 may be turned in respect to the second set of exterior teeth 36 during assembly and then may be secured in this position on the control shaft 23, for example, by clamping screws. In place of this toothed coupling employed as described above, it would also be possible to use a splined shaft connection, a feather key connection, or a polygon connection. The essential requirement is that the interlocking coupling 22 be capable of coupling the hollow shaft 16 and the control shaft 23 in a manner which prevents relative rotation between the two but which, at the same time allows for relative axial movement between the two.

In the preferred embodiment of the removable cylinder coupling in accordance with the present invention, the switchable coupling 27 between the first end 24 of the control shaft 23 and the journal 2 of the cylinder 1 is a toothed coupling having the two switchable coupling halves 26 and 28. The coupling half 26 attached to the control shaft 23 carries the second set of exterior teeth 36 of the interlocking coupling 22. Both of these coupling halves 26 and 28 have engageable coupling faces which are provided with radially extending grooved front serrations. These grooved front serrations are designed to interfit with each other and to form a positive coupling when the two switchable coupling halves 26 and 28 are in engagement, as is depicted in the sole drawing FIGURE. Engagement or separation of the switchable coupling halves 26 and 28 is accomplished by axial movement of the control shaft 23 through the operation of the pneumatic cylinder 32. It will be kept in mind that the bearing 31 at the second end 29 of the control shaft 23 allows the control shaft 23 to rotate while the pneumatic cylinder 32 is fixed in place.

Again referring to the sole drawing FIGURE, the operation of the coupling for a removable cylinder, in accordance with the present invention will now be discussed in detail. In the operational state of the coupling assembly, the pneumatic cylinder 32 is extended into its position toward the cylinder 1. Because of this, the control shaft 23 is also situated in its position close to the cylinder 1 and the switchable coupling 27 is therefore engaged, which means that the two grooved front serrations of the coupling halves 26 and 28 are pressed against each other. The switchable coupling 27 transmits a torque in the circumferential direction from the control shaft 23 to the cylinder journal 2 in a manner free of play. The torque is transmitted to the control shaft 23 by means of the interlocking coupling 22 from the drive wheel 18 through the hollow shaft 16o The drive wheel 18 turns the hollow shaft 16, which is rotatably supported by the bearing set 14 in the non-rotating bearing bushing 11, with the interlocking coupling 22 transmitting the torque. The interlocking coupling 22 transmits the rotary movement of the hollow shaft 16 to the control shaft 23 which, in turn, passes on the rotary movement to the cylinder 1 by means of the switchable coupling 27. As was discussed previously, at the end 29 of the control shaft 23 which is remote from the cylinder 1, the rotating control shaft 23 is separated from the non-rotating pneumatic cylinder 32 by means of the bearing 31 so that the control shaft 23 can rotate while the pneumatic cylinder 32 remains fixed in place. When it becomes necessary to remove the cylinder 1 from the rotary printing press, the cylinder 1 will be disengaged from the cylinder drive assembly, which includes the gear drive wheel 18, the hollow shaft 16, the control shaft 23, and the interlocking coupling 22 by actuation of the switchable coupling 27. The pneumatic cylinder 32 will be actuated to retract the control shaft 23 away from the cylinder journal 2. This will shift the control shaft 23 to the left in the axially fixed hollow shaft 16, as viewed in the sole drawing FIGURE. The shiftable coupling halves 26 and 28 will be shifted axially apart so that the cylinder 1 is now disengaged from the gear drive wheel 19 which itself will not have been disturbed. The control path or path of axial shifting of the switchable coupling 27 must be sufficient to separate the switchable coupling halves 26 and 28 sufficiently to allow vertical movement of the cylinder journal switchable coupling half 28 with respect to the control shaft switchable coupling half 26. This will allow the cylinder 1 to be moved vertically with respect to its axis of rotation 12.

Once the two switchable coupling halves 26 and 28 have been separated, by retraction of the pneumatic cylinder 32, the two half shells 6 and 7 of the bearing receptacle 4 can be released from each other. This will allow the cylinder 1, with its bearings 3 in place on the cylinder journals 2, to be removed from the printing press. In this removal process, the cylinder journal switchable coupling 27 will remain attached to the cylinder journal 2. To accommodate this removal of the cylinder 1 and the coupling half 28, the coupling half 28 and the opened half shell 6 of the bearing receptacle 4 are structured in such a way that the opened half shell 6 makes room axially in the direction facing away from the cylinder 1 for removal of the coupling half 28. Alternatively, the cylinder journal 2 could also be provided within a bore or a depression or recess in the end of the cylinder 1. This bore or recess could receive the coupling half 28 which could, in this way, be located below the bearing 3.

While a preferred embodiment of a removable cylinder coupling in accordance with the present invention has been set forth fully and completely hereinabove, it will be apparent to one of skill in the art that a number of changes in, for example, the overall size of the cylinder, the source of compressed air for the pneumatic cylinder, the type of teeth on the drive wheel and the like could be made without departing from the true spirit and scope of the present invention which is accordingly to be limited only by the following claims.

What is claimed is:

1. A coupling for a removable cylinder in a rotary printing press comprising:

a cylinder having cylinder end journals with cylinder bearings supported on said cylinder end journals;

a separable bearing receptacle which receives said cylinder end bearings;

a bearing bushing supported in a frame of said press and having a first end face, said bearing receptacle being attached to said first end face of said bearing bushing, said bearing bushing further having a central axial bore;

a hollow shaft supported in said bearing bushing bore for rotational movement with respect to said bearing bushing, said hollow shaft having an end remote from said cylinder, said hollow shaft further having a central, axially extending bore;

a cylinder drive wheel attached to said remote end of said hollow shaft;

a control shaft supported in said hollow shaft bore for axial movement with respect to said hollow shaft;

an interlocking coupling connecting said control shaft and said hollow shaft for relative axial movement therebetween; and a switchable coupling connecting said cylinder journals and said control shaft.

2. The coupling for a removable cylinder in accordance with claim 1 wherein said switchable coupling has a control shaft switchable coupling half and a cylinder journal switchable coupling half, said coupling halves each being provided with front faces having grooved serrations which are engageable with each other.

3. The coupling for a removable cylinder in accordance with claim 1 wherein said interlocking coupling includes interior teeth on an inner surface of said hollow shaft and further includes first and second sets of exterior teeth, said first and second sets of teeth being radially shiftable with respect to each other and further being shaped to cooperatively engage said interior teeth.

4. The coupling for a removable cylinder in accordance with claim 1 further including a non-rotating adjustment device usable to shift said control shaft axially in said hollow shaft and further including a bearing connection between said control shaft and said non-rotating adjustment device.

5. The coupling for a removable cylinder in accordance with claim 1 wherein said bearing receptacle is comprised of first and second half shells which can be connected to each other to form said separable bearing receptacle and further wherein one of said first and second half shells is fixedly connected to said bearing bushing.

* * * * *